US010166443B2

(12) United States Patent
Nakamura et al.

(10) Patent No.: US 10,166,443 B2
(45) Date of Patent: Jan. 1, 2019

(54) GOLF CLUB HEAD

(71) Applicant: SUMITOMO RUBBER INDUSTRIES, LTD., Kobe-shi, Hyogo (JP)

(72) Inventors: Takashi Nakamura, Kobe (JP); Mika Becktor, Huntington Beach, CA (US)

(73) Assignee: SUMITOMO RUBBER INDUSTRIES, LTD., Kobe-shi, Hyogo (JP)

( * ) Notice: Subject to any disclaimer, the term of this patent is extended or adjusted under 35 U.S.C. 154(b) by 0 days.

(21) Appl. No.: 15/952,753

(22) Filed: Apr. 13, 2018

(65) Prior Publication Data

US 2018/0296886 A1 Oct. 18, 2018

(30) Foreign Application Priority Data

Apr. 14, 2017 (JP) ..... 2017-080987

(51) Int. Cl.
*A63B 53/08* (2015.01)
*A63B 53/04* (2015.01)

(52) U.S. Cl.
CPC ..... *A63B 53/0466* (2013.01); *A63B 53/08* (2013.01); *A63B 2053/0433* (2013.01); *A63B 2053/0437* (2013.01); *A63B 2053/0495* (2013.01)

(58) Field of Classification Search
CPC .... A63B 2053/0433; A63B 2053/0495; A63B 53/08; A63B 53/0466
USPC ..... 473/328, 344, 324
See application file for complete search history.

(56) References Cited

U.S. PATENT DOCUMENTS 5,643,107 A * 7/1997 Gorman ..... A63B 53/04 473/328
5,785,609 A * 7/1998 Sheets ..... A63B 53/04 473/327
6,332,848 B1 * 12/2001 Long ..... A63B 53/04 473/328
7,717,807 B2 * 5/2010 Evans ..... A63B 53/0466 473/344
2011/0021284 A1 * 1/2011 Stites ..... A63B 53/04 473/329
2012/0135821 A1 * 5/2012 Boyd ..... A63B 53/0466 473/342
2015/0045140 A1 * 2/2015 Fossum ..... A63B 53/0466 473/329
2015/0367205 A1 * 12/2015 Boggs ..... A63B 53/04 473/350
2016/0325155 A1 11/2016 Llewellyn et al.

* cited by examiner

*Primary Examiner* — Benjamin Layno
(74) *Attorney, Agent, or Firm* — Birch, Stewart, Kolasch & Birch, LLP

(57) ABSTRACT

A golf club head according to the present invention includes a face portion, a crown portion and a sole portion, the sole portion including a toe-side recessed portion arranged on a toe side, a heel-side recessed portion arranged on a heel side, and a middle recessed portion arranged between the toe-side recessed portion and the heel-side recessed portion, and at least one readily deformable portion that extends linearly in a toe-heel direction is formed in the toe-side recessed portion and the heel-side recessed portion.

16 Claims, 8 Drawing Sheets

E1 Cross section

GOLF CLUB HEAD

TECHNICAL FIELD

The present invention relates to a golf club head.

BACKGROUND ART

In relation to the head of wood-type golf clubs, many proposals for increasing the carry distance have been made heretofore. For example, in US2016/0325155, a plurality of grooves extending in the toe-heel direction are formed in the sole portion, thereby facilitating deformation at the time of impact with the ball and improving rebound performance.

US2016/0325155 is an example of related art.

SUMMARY OF THE INVENTION

Incidentally, the above grooves in the golf club are formed such that a vicinity of the middle thereof in the toe-heel direction is proximal to the face portion, and the toe side and the heel side thereof are distanced from the face portion. Thus, even though the rebound performance in a vicinity of the middle in the toe-heel direction increases, there is room for improvement in enhancing the rebound performance on the toe side and the heel side. The present disclosure was made in order to solve the above problem, and an object thereof is to provide a golf club head that is able to enlarge the area having a high rebound performance on the toe side and the heel side.

A golf club head according to the present invention is provided with a face portion, a crown portion and a sole portion, the sole portion including a toe-side recessed portion arranged on a toe side, a heel-side recessed portion arranged on a heel side, and a middle recessed portion arranged between the toe-side recessed portion and the heel-side recessed portion, and at least one readily deformable portion that extends linearly in a toe-heel direction being formed in the toe-side recessed portion and the heel-side recessed portion.

In the above golf club head, two or more of the readily deformable portion can be formed in the toe-side recessed portion and the heel-side recessed portion, at least one readily deformable portion extending linearly in the toe-heel direction can be formed in the middle recessed portion, and a number of the readily deformable portions formed in the toe-side recessed portion and the heel-side recessed portion can be made greater than a number of the readily deformable portions formed in the middle recessed portion.

In the above golf club heads, a length of the toe-side recessed portion and the heel-side recessed portion in a face-back direction can be made greater than a length of the middle recessed portion in the face-back direction.

In the above golf club heads, the toe-side recessed portion can be formed to increase in length in the face-back direction moving toward the toe side, and the heel-side recessed portion can be formed to increase in length in the face-back direction moving toward the heel side.

In the above golf club heads, the toe-side recessed portion and the heel-side recessed portion can be arranged further on a face side than the middle recessed portion.

In the above golf club heads, the readily deformable portion arranged in the toe-side recessed portion can be formed to extend further on the back side moving toward the toe side, and the readily deformable portion arranged in the heel-side recessed portion can be formed to extend further on the back side moving toward the heel side.

In the above golf club heads, a depth of the toe-side recessed portion can be formed shallower moving toward the toe side, and a depth of the heel-side recessed portion can be formed shallower moving toward the heel side.

In the above golf club heads, a thickness of the toe-side recessed portion and the heel-side recessed portion can be made smaller than a thickness of the middle recessed portion.

In the above golf club heads, the readily deformable portion of the toe-side recessed portion, the heel-side recessed portion and the middle recessed portion can be formed by a step.

With a golf club head according to the present invention, the rebound performance on the toe side and the heel side can be improved, while suppressing the rebound performance in a vicinity of the middle in the toe-heel direction.

EMBODIMENTS OF THE INVENTION

Hereinafter, an embodiment of a golf club head according to the present invention will be described, with reference to the drawings.

1. Overview of Golf Club Head

Figure 1:
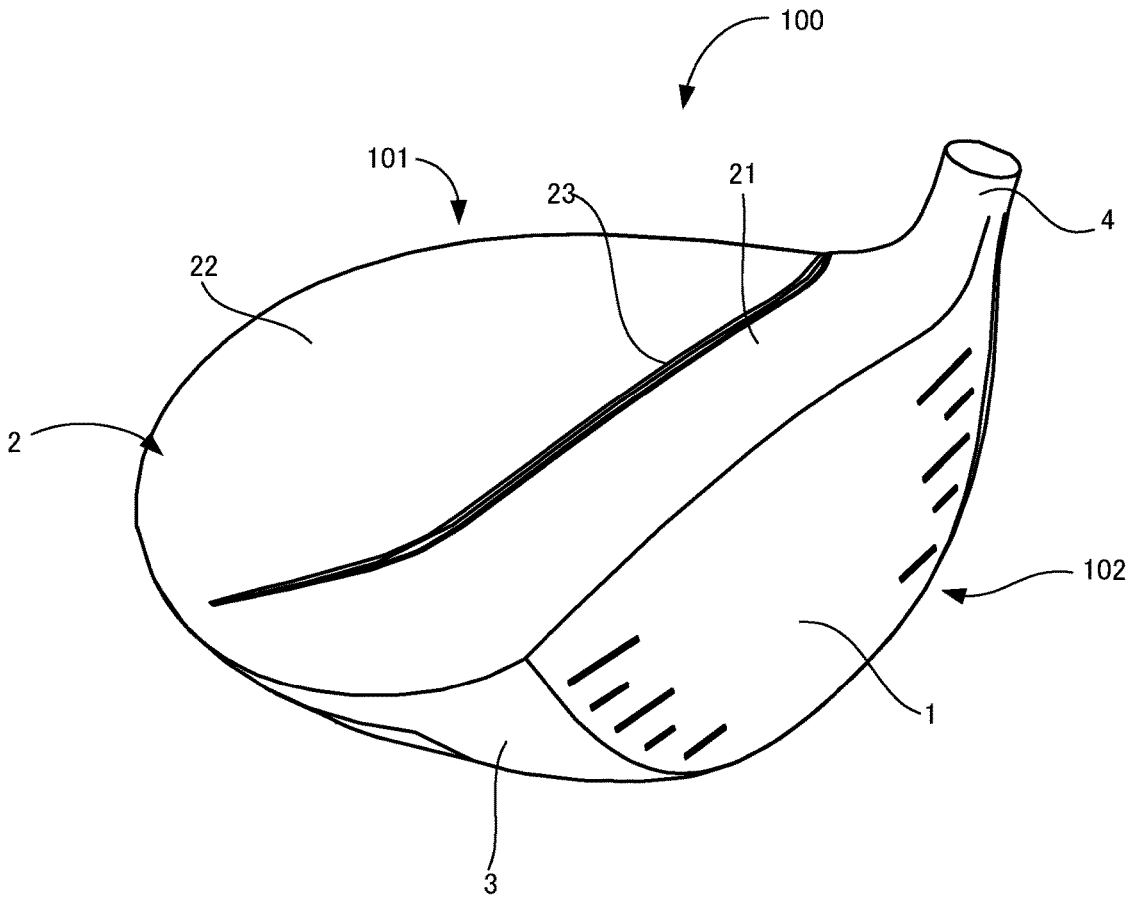
FIG. 1 is a perspective view of a reference state of a golf club head according to the present embodiment.
Figure 2:
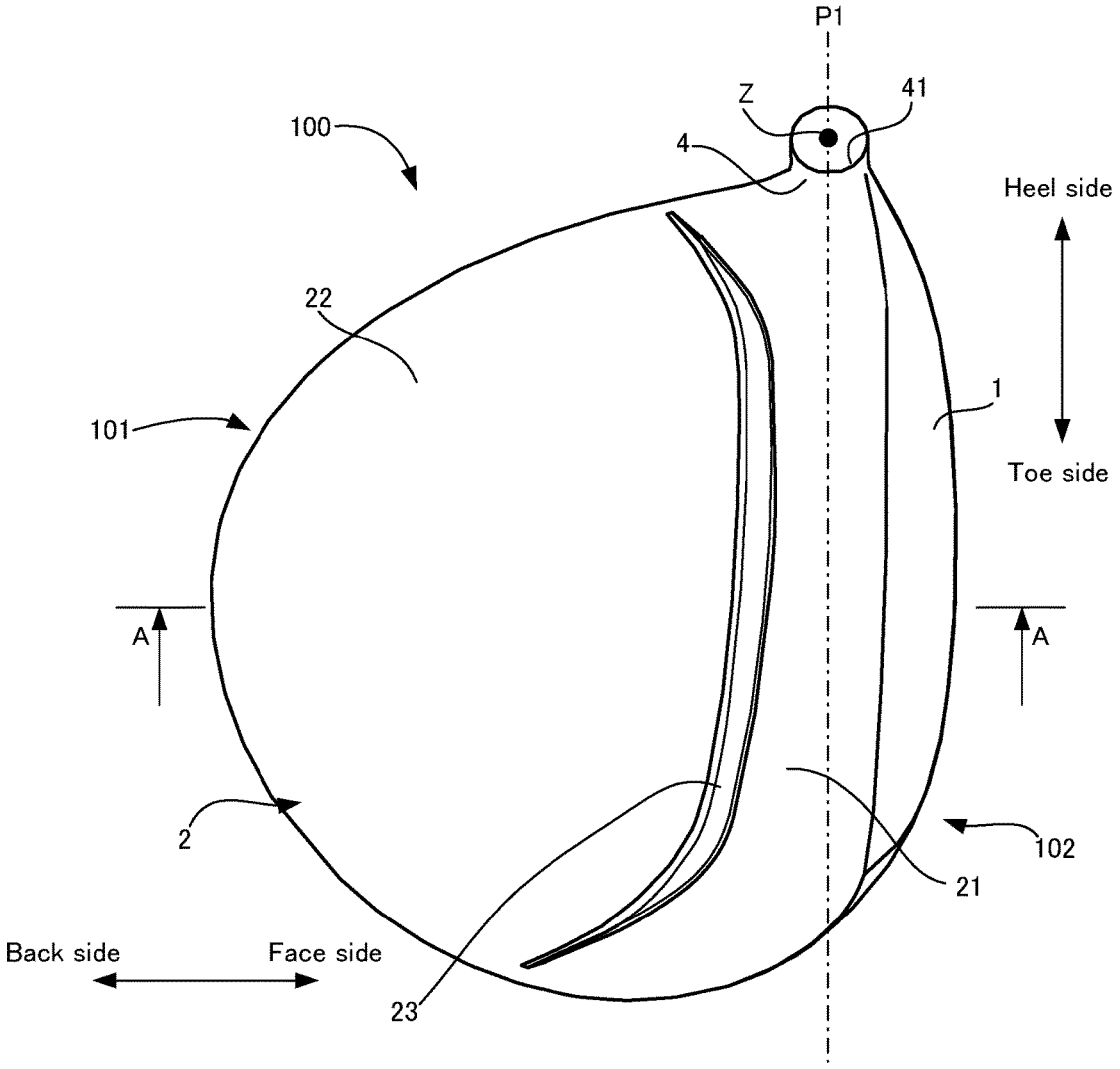
FIG. 2 is a plan view of FIG. 1.
Figure 3:
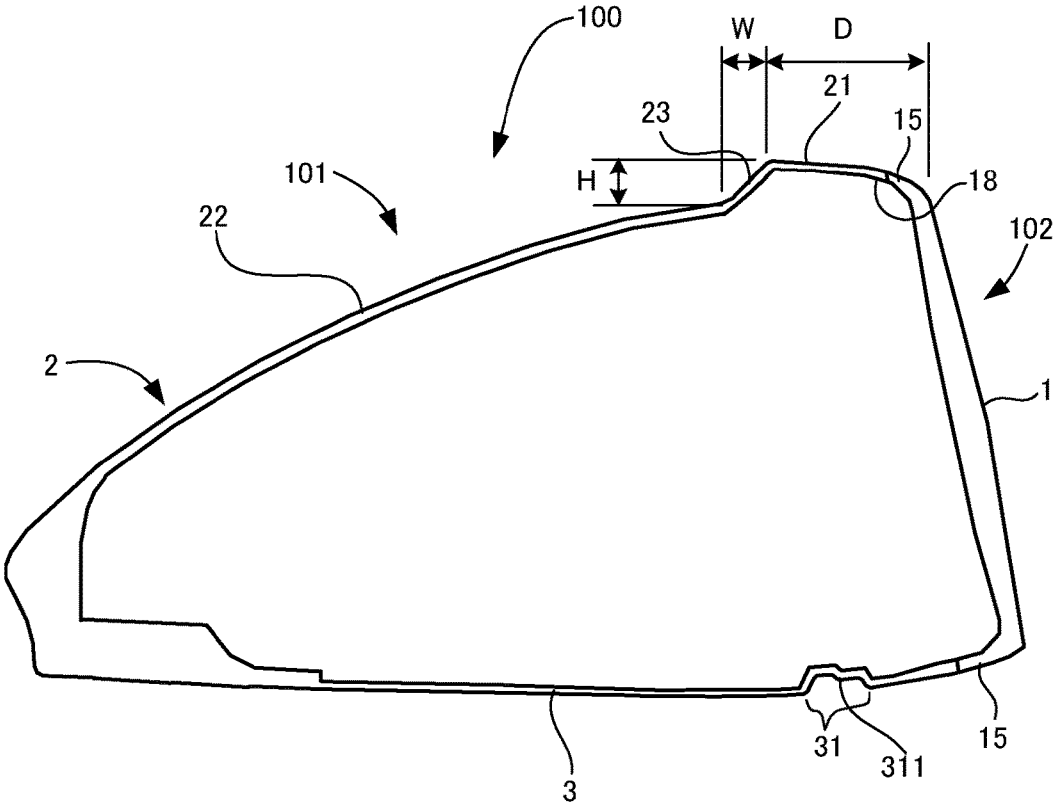
FIG. 3 is a cross-sectional view along an A-A line in FIG. 2.

FIG. 1 is a perspective view of this golf club head, FIG. 2 is a plan view of the head in a reference state, and FIG. 3 is a cross-sectional view along an A-A line in FIG. 2. As shown in FIGS. 1 to 3, this golf club head (hereinafter, may be simply referred to as "head") 100 is a wood-type golf club head having a hollow structure with an internal space, and a wall surface is formed by a face portion 1, a crown portion 2, a sole portion 3 and a hosel portion 4. Specifically, the present invention is applicable to golf club heads such as utilities, fairway woods and drivers.

The face portion 1 has a face surface which is the surface that hits the ball, and the crown portion 2 adjoins the face portion 1 and constitutes the upper surface of the head 100. The sole portion 3 mainly constitutes the bottom surface of the head 100, and constitutes the outer peripheral surface of the head 100 other than the face portion 1 and the crown portion 2. That is, besides the bottom surface of the head 100, the region extending from the toe side of the face portion 1 around the back side of the head to the heel side of the face portion 1 is also part of the sole portion 3. Furthermore, the hosel portion 4 is a region that is provided adjoining the heel side of the crown portion 2, and has an insertion hole 41 into which the shaft (illustration omitted) of the golf club is inserted. A center axis line Z of this insertion hole 41 coincides with the axis line of the shaft.

Here, the reference state when setting the golf club head 100 on the ground will be described. First, as shown in FIG. 2, a state where the above center axis line Z is contained in a plane P1 that is perpendicular to the ground and the head is placed on the ground at a predetermined lie angle and real loft angle is prescribed as the reference state. The above plane P1 will be referred to as the reference perpendicular plane. Also, as shown in FIG. 2, the line of intersection between the above reference perpendicular plane P1 and the ground will be referred to as the toe-heel direction, and the direction perpendicular to this toe-heel direction and parallel to the ground will be referred to as the face-back direction.

Figure 4A:
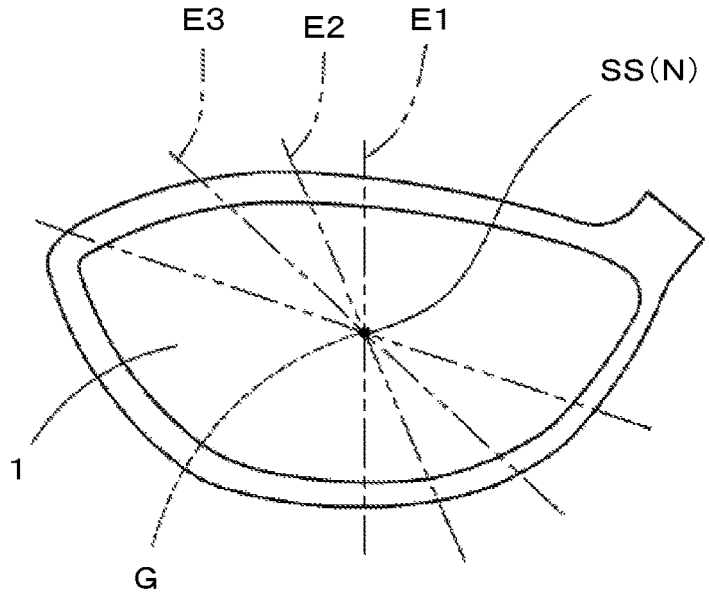
FIG. 4A is a diagram illustrating the boundary of a face portion.
Figure 4B:
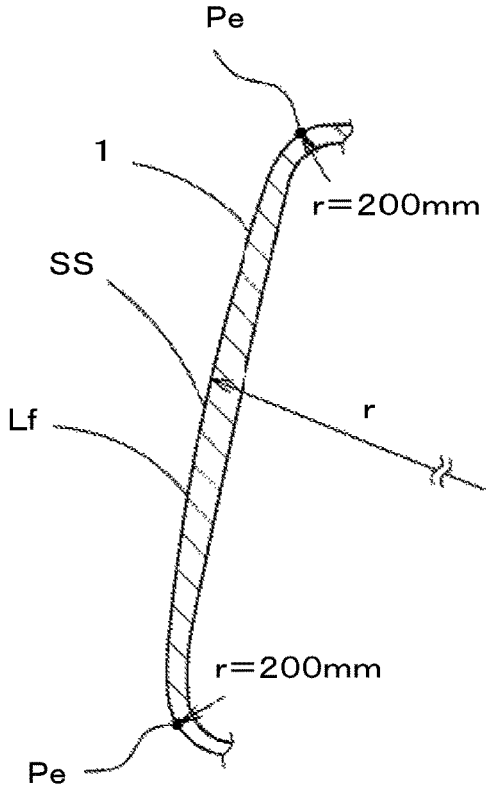
FIG. 4B is a diagram illustrating the boundary of the face portion.

In the present embodiment, the boundary between the face portion 1 and the crown portion 2 and between the face portion 1 and the sole portion 3 can be defined as follows. That is, in the case where a ridgeline is formed therebetween, this ridgeline will be the boundary. On the other hand, in the case where a clear ridgeline is not formed, in each of cross-sections E1, E2, E3 and so forth that contain a straight line N connecting a head center of gravity G and a sweet spot SS, as shown in FIG. 4A, a position Pe at which a curvature radius r of a contour line Lf of the face outer surface first reaches 200 mm in a direction toward the face outer side from the sweet spot side, as shown in FIG. 4B, will be the periphery of the face portion 1, and this periphery is defined as the boundary with the crown portion 2 or the sole portion 3. Note that the sweet spot SS is the point of intersection between the normal (straight line N) of the face surface that passes through the head center of gravity G and this face surface.

Also, in the present embodiment, the boundary between the crown portion 2 and the sole portion 3 can be defined as follows. That is, in the case where a ridgeline is formed between the crown portion 2 and the sole portion 3, this ridgeline will be the boundary. On the other hand, in the case where a clear ridgeline is not formed therebetween, the contour when the head is set in the reference state and viewed from directly above the center of gravity of the head 100 will be the boundary.

Also, the head 100 can, for example, be formed with a titanium alloy (Ti-6Al-4V, Ti-8Al-1Mo-1V, etc.) having a specific gravity of substantially about 4.3 to 4.5. Also, apart from a titanium alloy, the head can also be formed using one or two or more materials selected from stainless steel, maraging steel, an aluminum alloy, a magnesium alloy and an amorphous alloy, for example.

Also, the volume of this golf club head 100 is desirably from 90 $cm^3$ to 460 $cm^3$ inclusive, for example.

2. Assembly Structure of Golf Club Head

The golf club head 100 according to the present embodiment is constituted, as shown in FIG. 3, by assembling a head main body 101 having a crown portion 2 and a sole portion 3 and a cup-shaped face member 102 having a face portion 1 and a peripheral portion 15 extending from the periphery of the face portion. This head main body 101 has an opening 18 enclosed by the crown portion 2 and the sole portion 3, and the face member 102 is attached so as to close off this opening 18. That is, an end face of the peripheral portion 15 of the face member 102 is butted against an end face of the opening 18 of the head main body 101, and these portions are joined by welding (so-called cup face structure). The face member 102 is integrated with the head main body 101, by being attached to an edge portion of the opening 18 of the head main body 101, and the peripheral portion 15 of the face member 102 thereby functions as part of the crown portion 2 and the sole portion 3 of the head 100.

Accordingly, the surface that is integrally formed as a result of the peripheral portion 15 of the face member 102 being attached to the head main body 101 constitutes the crown portion 2 and the sole portion 3 of the head 100. Thus, strictly speaking, the crown portion 2 and the sole portion 3 of the head main body 101 are part of the crown portion 2 and the sole portion 3 of the head 100, although, in this specification, these portions of the head main body 101 may also be referred to simply as the crown portion 2 and the sole portion 3, without making this distinction.

3. Structure of Crown Portion

Next, the crown portion 2 will be described. As shown in FIGS. 1 to 3, the crown portion 2 is constituted by a raised portion 21 that is arranged on the face portion side and a base portion 22 that is arranged further on the back side than the raised portion 21. The raised portion 21 is mainly a band-like region extending in the toe-heel direction along the face portion 1, with the respective end portions on the toe and heel sides extending slightly to the back side along the periphery of the crown portion 2, and is formed as a whole to be U-shaped in plan view. On the other hand, the base portion 22 is a region that occupies most of the crown portion 2 at a lower position than the raised portion 21, and the periphery thereof contacts the sole portion 3. A sloped surface 23 that constitutes a step is formed on the boundary between the raised portion 21 and the base portion 22. The height of the face portion 1 in the up-down direction is thereby increased by the amount of the step between the raised portion 21 and the base portion 22.

This sloped surface 23 is configured so as to extend upward, moving toward the face portion 1 side. The sloped surface 23 can thereby be sighted from above, when the golf club head 100 is set in the reference state. That is, the sloped surface can be sighted by the golfer at address. The sloped surface 23 is formed along the raised portion 21, and is thus formed to be U-shaped in plan view, similarly to the raised portion 21.

As shown in FIG. 3, a width D of the raised portion 21 in the face-back direction is, in plan view, preferably set from 5 to 25 mm, and more preferably from 7 to 20 mm, for example.

Also, as shown in FIG. 3, a width W of the sloped surface 23 in the face-back direction in plan view is preferably set from 3 to 9 mm, and more preferably from 3 to 7 mm, for example. Furthermore, a height H of the sloped surface 23 is preferably set from 0.5 to 8 mm, more preferably from 0.5 to 6 mm, and particularly preferably from 0.5 to 5 mm, for example.

4. Structure of Sole Portion

Figure 5:
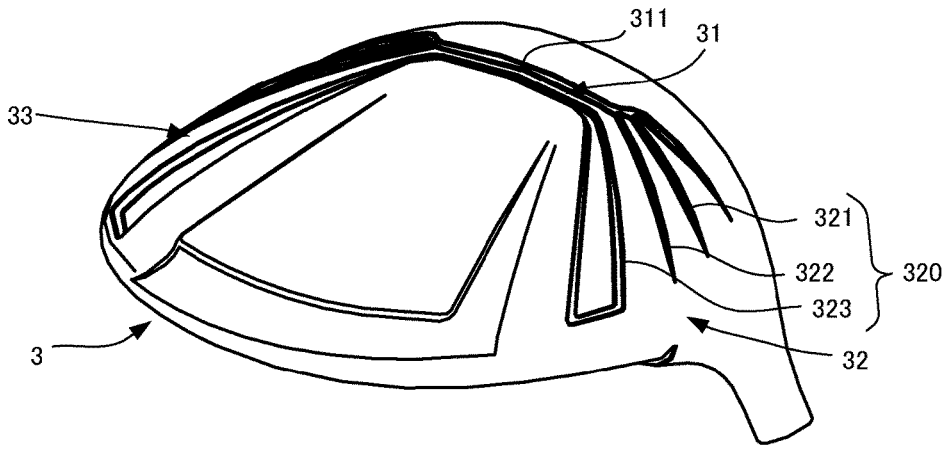
FIG. 5 is a perspective view of a sole portion as seen from the back side.
Figure 6:
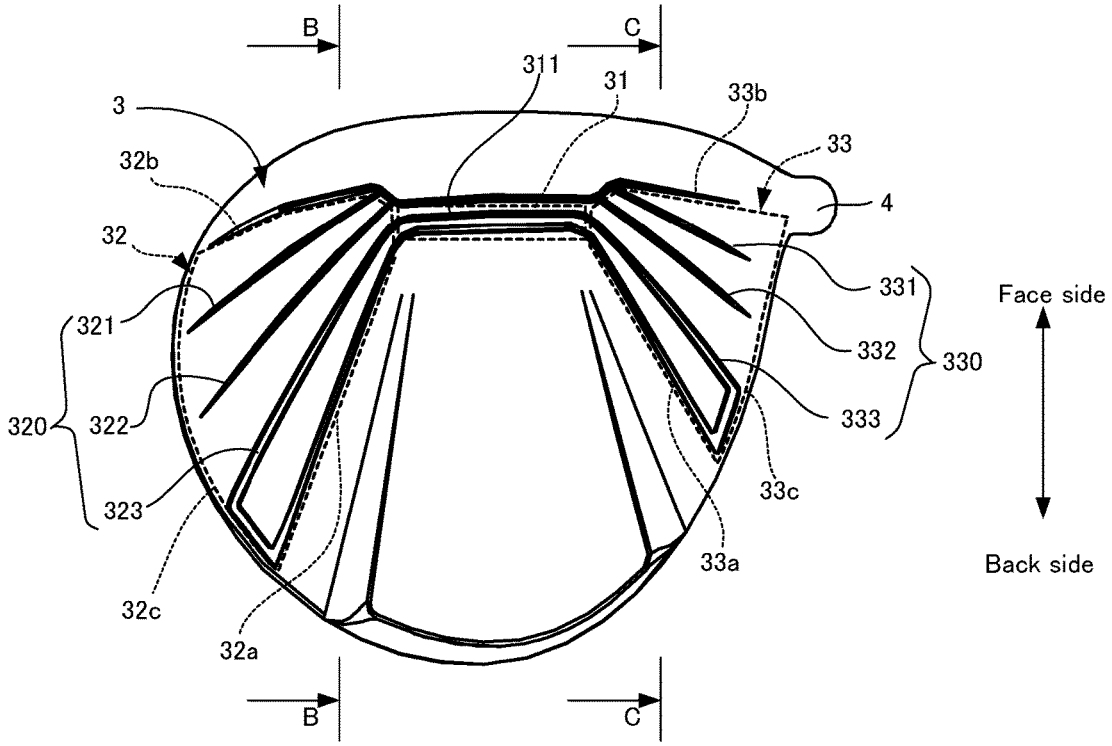
FIG. 6 is a plan view of the sole portion.
Figure 7:
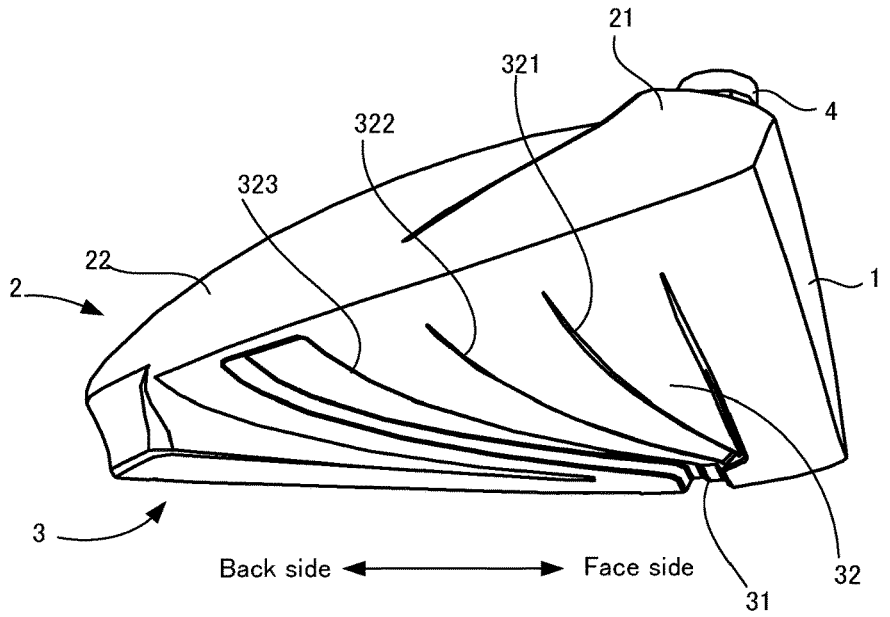
FIG. 7 is a side view of the head as seen from the toe side.
Figure 8:
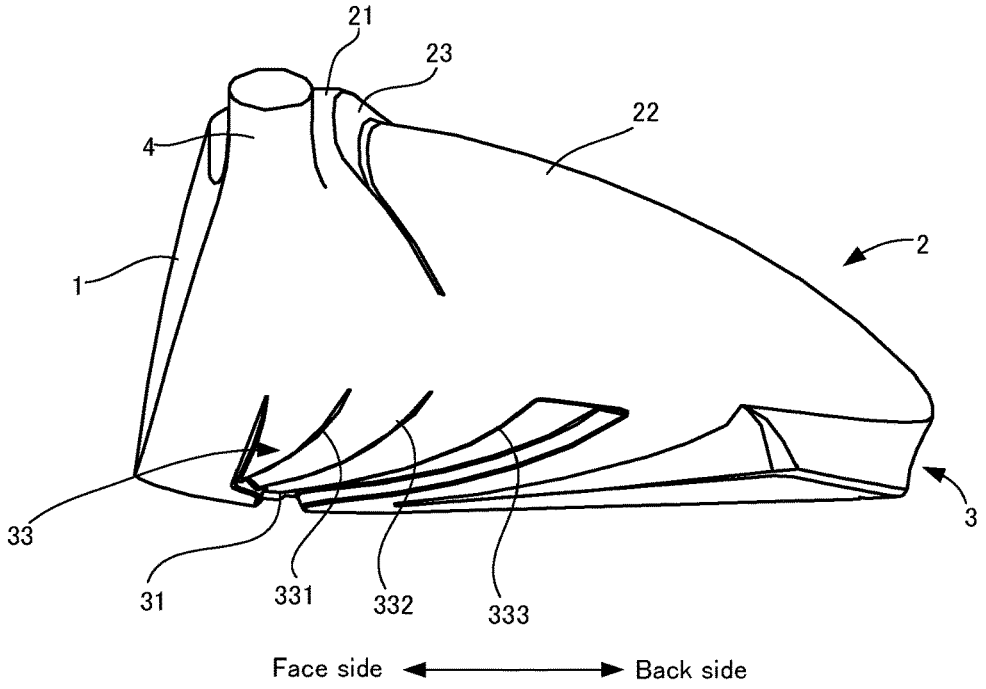
FIG. 8 is a side view of the head as seen from the heel side.
Figure 9:
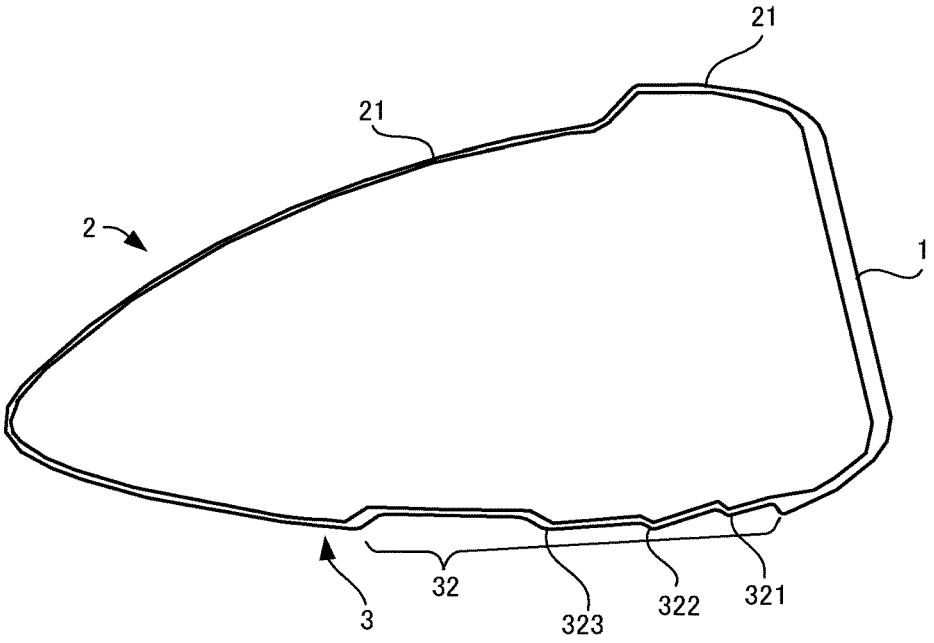
FIG. 9 is a cross-sectional view along a B-B line in FIG. 6.
Figure 10:
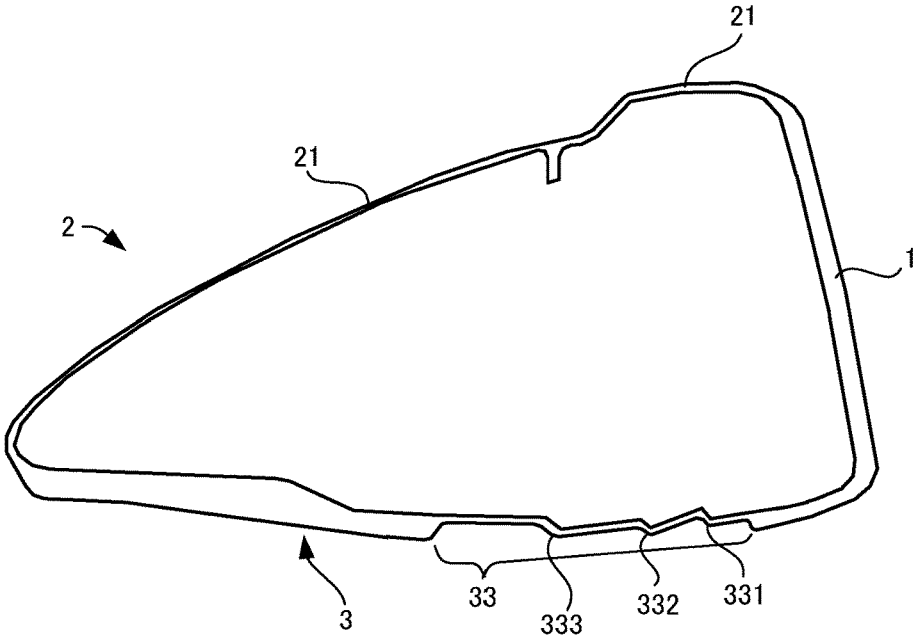
FIG. 10 is a cross-sectional view along a C-C line in FIG. 6.

Next, the sole portion 3 will be described, with reference also to FIGS. 5 to 10. FIG. 5 is a perspective view of the sole portion as seen from the back side, FIG. 6 is a plan view of the head as seen from the sole portion side, FIG. 7 is a side view of the head as seen from the toe side, FIG. 8 is a side view of the head as seen from the heel side, FIG. 9 is a cross-sectional view along a B-B line in FIG. 6, and FIG. 10 is a cross-sectional view along a C-C line in FIG. 6. As shown in FIGS. 5 to 10, a plurality of recesses and protrusions are formed in the sole portion 3, and in the present embodiment, in particular, three recessed portions are formed. Also, a readily deformable portion extending in the toe-heel direction is formed in each recessed portion. Hereinafter, these portions will be described in more detail.

4-1. Recessed Portions

First, the recessed portions will be described. As shown in FIGS. 6 to 10, a middle recessed portion 31 that is arranged in a vicinity of the middle in the toe-heel direction, a toe-side recessed portion 32 that is arranged on the toe side adjoining this middle recessed portion 31, and a heel side-side recessed portion 33 that is arranged on the heel side adjoining the middle recessed portion 31 are formed in the sole portion 3. The middle recessed portion 31 is proximal to the face portion 1, and is formed in a rectangular shape whose longitudinal direction is in the toe-heel direction. The distance between the end edge on the face side of the middle recessed portion 31 and the face portion 1 can be set from 13.0 to 28.0 mm, for example. Also, the thickness of the wall surface that forms the middle recessed portion 31 can be set from 0.8 to 3.0 mm, for example.

The toe-side recessed portion 32 is connected to an end portion on the toe side of the middle recessed portion 31, and is formed in a generally triangular shape toward the toe side. To be more specific, an end edge 32*a* on the heel side of the toe-side recessed portion 32 extends on the back side from a connection portion with the middle recessed portion 31, and slopes so as to extend further on the back side moving toward the toe side. Also, an end edge 32*b* on the face side of the toe-side recessed portion 32 extends in the toe-heel direction so as to follow the boundary between the face portion 1 and the sole portion 3. This end edge 32*b* on the face side is, however, located slightly further on the face side than the end edge on the face side of the middle recessed portion 31. Also, an end edge 32*c* on the toe side of the toe-side recessed portion 32 extends along the boundary between the sole portion 3 and the crown portion 2. Accordingly, the toe-side recessed portion 31, as a whole, is formed in a shape whose length in the face-back direction generally becomes longer moving toward the toe side.

Also, the toe-side recessed portion 32 is formed to become shallower, moving toward the toe side. That is, in the toe-side recessed portion 32, the depth of the end edge 32*a* that is connected to the middle recessed portion 31 is from 0.5 to 3.0 mm, for example, but becomes shallower moving toward the toe side, and, at the end edge 32*c* on the toe side, can be set from 0.1 to 1.5 mm, for example. Also, the thickness of the wall surface forming the toe-side recessed portion 32 is thinner than the middle recessed portion 31, and can be set from 0.4 to 1.5 mm, for example.

The heel-side recessed portion 33 is formed to be generally symmetrical to the toe-side recessed portion 32. That is, the heel-side recessed portion 33 is connected to an end portion on the heel side of the middle recessed portion 31, and is formed in a generally triangular shape toward the heel side. To be more specific, an end edge 33*a* on the toe side of the heel-side recessed portion 33 extends on the back side from a connection portion with the middle recessed portion 31, and slopes so as to extend further on the back side moving toward the heel side. Also, the end edge 33*b* on the face side of the heel-side recessed portion 33 extends in the toe-heel direction so as to follow the boundary between the face portion 1 and the sole portion 3. This end edge 33*b* on the face side is, however, arranged in a similar position to the toe-side recessed portion 32. That is, the end edge 33*b* is located slightly further on the face side than the end edge on the face side of the middle recessed portion 31. Also, an end edge 33*c* on the heel side of the heel-side recessed portion 33 extends along the boundary between the sole portion 3 and the crown portion 2. Accordingly, the heel-side recessed portion 33, as a whole, is formed in a shape whose length in the face-back direction increases moving toward the heel side.

Also, the heel-side recessed portion 33 is formed to become shallower, moving toward the heel side. That is, the depth of the end edge that is connected to the middle recessed portion 31 is from 0.5 to 3.0 mm, for example, but becomes shallower moving toward the heel side, and, at the end edge on the heel side, can be set from 0.1 to 1.5 mm, for example. Also, the thickness of the wall surface that forms the heel-side recessed portion 33 is thinner than the middle recessed portion 31, and can be from 0.4 to 1.5 mm, for example.

4-2. Readily Deformable Portions

Figure 11:
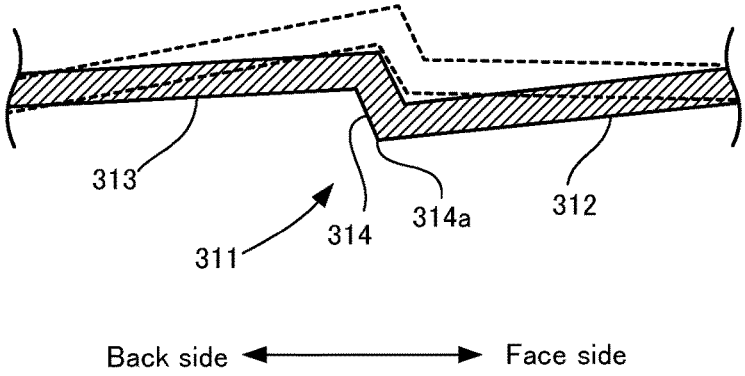
FIG. 11 is an enlarged cross-sectional view of a middle recessed portion.

Next, the readily deformable portions will be described, with reference to FIG. 3 and FIGS. 6 to 11. FIG. 11 is an enlarged cross-sectional view showing a schematic configuration of a readily deformable portion. As shown in FIGS. 3 and 6, one readily deformable portion 311 extending in the toe-heel direction is formed in the middle recessed portion 31. This readily deformable portion 311 extends across the entirety of the middle recessed portion 31 in the toe-heel direction, and is formed by a step portion. That is, as shown in FIG. 11, the surface constituting a step portion 314 extends generally in the up-down direction, a surface 312 on the face side is connected to a lower end of the step portion 314, and a surface 313 on the back side is connected to an upper end of the step portion 314 across the step portion 314. An apex portion 314*a* (most downwardly projecting portion) of the step portion is, however, located further on the inner side (upper side) than the surface of the sole portion 3.

Next, a readily deformable portion 320 of the toe-side recessed portion 32 will be described. As shown in FIGS. 6, 7 and 9, in the toe-side recessed portion 32, three readily deformable portions 321 to 323 that are arranged side-by-side in the face-back direction are formed. Hereinafter, these three readily deformable portions will be referred to as a first readily deformable portion 321, a second readily deformable portion 322 and a third readily deformable portion 323 from the face side. These readily deformable portions 321 to 323 are also formed by a step portion, similarly to the readily deformable portion 311 shown in FIG. 11. Accordingly, in these readily deformable portions 321 to 323, the surface on the face side is connected to a lower end of the step portion, and the surface on the back side is connected to an upper end of the step portion across the step portion extending generally in the up-down direction. An apex portion (most downwardly projecting portion) of the step portion is, however, located further on the inner side (upper side) than the surface of the sole portion 3.

The first readily deformable portion 321 is arranged furthest on the face side, and is formed to extend further on the back side moving toward the toe side. The second readily deformable portion 322 and the third readily deformable portion 323 are similarly formed. The distance between adjoining readily deformable portions such as the first readily deformable portion 321 and the second readily deformable portion 322, for example, is formed such that the interval in the face-back direction widens, moving toward the toe side.

Next, a readily deformable portion 330 of the heel-side recessed portion 33 will be described. As shown in FIGS. 6, 8 and 10, three readily deformable portions 331 to 333 that are arranged side-by-side in the face-back direction are also formed in the heel-side recessed portion 33. Hereinafter, these three readily deformable portions will be referred to as a first readily deformable portion 331, a second readily deformable portion 332 and a third readily deformable portion 333 from the face side. These readily deformable portions 331 to 333 are also formed by a step portion. Accordingly, in these readily deformable portions 331 to 333, the surface on the face side is connected to a lower end of the step portion, and the surface on the back side is connected to an upper end of the step portion across the step portion extending generally in the up-down direction. An apex portion (most downwardly projecting portion) of the step portion is, however, located further on the inner side (upper side) than the surface of the sole portion 3.

The first readily deformable portion 331 is arranged furthest on the face side, and is formed to extend further on the back side moving toward the heel side. The second readily deformable portion 332 and the third readily deformable portion 333 are similarly formed. The distance between adjoining readily deformable portions such as the first readily deformable portion 331 and the second readily deformable portion 332, for example, is formed such that the interval in the face-back direction widens, moving toward the heel side.

5. Manufacturing Method of Golf Club Head

Next, an example of the manufacturing method of the above golf club head will be described. First, the above-mentioned head main body 101 and face member 102 are prepared. A head main body 101 and a face member 102 such as described above can be produced with various methods. For example, the head main body 101 can be manufactured by casting such as a well-known lost wax precision casting process. Also, the face member 102 can be manufactured by a method such as forging, plate pressing or casting, for example. Also, the pre-processing plate of the face member 102 that is used at this time is processed such that the rolling direction substantially coincides with the direction from an upper portion on the toe side of the face portion 1 to a lower portion on the heel side.

The golf club head is then completed when predetermined coating is performed after joining these portions by welding (TIG (tungsten inert gas) welding, plasma welding, laser welding, brazing, etc.), for example.

6. Features

According to the above embodiment, the following effects can be obtained.

(1) Since a vicinity of the middle of the face portion 1 in the toe-heel direction is long in the up-down direction and there also exists the sweet spot, rebound performance is inherently high, compared with the toe side and the heel side. In view of this, in the present embodiment, as described below, the rebound performance of the face portion 1 on the toe side and the heel side is improved, and the area having a high rebound performance is enlarged on the toe side and the heel side. That is, with the golf club head according to the present embodiment, the recessed portions 31 to 33 are respectively formed in a vicinity of the middle in the face-back direction and on the toe side and the heel side of the sole portion 3, enabling deformation of the sole portion 3 to be increased, when the ball is hit with the face portion 1. Accordingly, the rebound performance of the head can be increased. Also, the readily deformable portions 311, 320 (321 to 323), and 330 (331 to 333) extending linearly are respectively formed in the middle recessed portion 31, the toe-side recessed portion 32 and the heel-side recessed portion 33. Since these readily deformable portions 311, 320 and 330 are formed by a step portion and thus readily deform due to the readily deformable portions 311, 320 and 330 flexing (e.g., deforming such as shown by the dotted lines in FIG. 11) when the ball hits the face portion 1, the rebound performance can be improved. The number of readily deformable portions 320 and 330 that are formed in the toe-side recessed portion 32 and the heel-side recessed portion 33 is, however, greater than the number of readily deformable portions 311 in the middle recessed portion 31. Thus, the rebound performance of the face portion 1 on the toe side and the heel side can be improved, and the area having a high rebound performance can be enlarged to the toe side and the heel side.

In particular, since the recessed portions 31 to 33 are depressed on the inner side (upward) of the head, the center of gravity of the head is thereby raised, but as a result of forming the readily deformable portions 311, 320 and 330, there is the advantage of being able to enhance the rebound performance without making the recessed portions 31 to 33 deeper. Therefore, the rebound performance can be enhanced, while suppressing the rise in the center of gravity of the head.

(2) Since the toe-side recessed portion 32 and the heel-side recessed portion 33 are closer to the face portion 1 than the middle recessed portion 31, the rebound performance of the face portion 1 on the toe side and the heel side improves, compared with a vicinity of the middle.

(3) Since the readily deformable portions 311, 320 and 330 are formed by creating bends in the surface constituting the sole portion 3, weight increases compared with other portions. The readily deformable portions 320 and 330 that are formed in the toe-side recessed portion 32 and the heel-side recessed portion 33 are formed to be distanced further from the middle recessed portion 31, moving toward the back side. Thus, the heavier portions will be located on the back side. As a result, the center of gravity of the head can be arranged on the back side. The back side of the head thereby becomes easier to rotate downwardly toward the face side, when the golf club is swung, particularly at the time of impact with ball. Since the face portion 1 thereby becomes easier to orient upwardly, the ball can be hit higher.

(4) The periphery of the sole portion 3 curves upwardly and is connected to the periphery of the crown portion 2. Thus, the toe-side recessed portion 32 is formed to be arranged further upward moving toward the toe side, and the heel-side recessed portion 33 also formed to be arranged further upward moving toward the heel side. However, since the toe-side recessed portion 32 and the heel-side recessed portion 33 are both formed to become shallower moving toward the periphery, the weight of the periphery of the sole portion 3 is prevented from being distributed upward. A rise in the center of gravity of the head can thereby be prevented.

(5) Since the thickness of the wall surfaces forming the toe-side recessed portion 32 and the heel-side recessed portion 33 is thinner than the middle recessed portion 31, the rebound performance of the face portion 1 on the toe side and the heel side improves, compared with a vicinity of the middle.

(6) In the crown portion 2, the raised portion 21 is formed higher than the base portion 22 via the sloped surface 23, thus enabling the height of the face portion 1 to be increased by the height of the raised portion 21. Thus, the rebound performance of the face portion 1 can be improved. Also, in the crown portion 2, only the raised portion 21 is formed higher, and the base portion 22 occupying most of the crown portion 2 is formed at a lower position than the raised portion 21, thus enabling the center of gravity of the head to be lowered.

7. Variations

Although an embodiment of the present invention is described above, the present invention is not limited to the above embodiment, and various modifications can be made without departing from the spirit of the invention. Also, the following variations can be appropriately combined. Modifications such as the following can be made, for example.

<7-1>

The number of readily deformable portions is not particularly limited, and the number of readily deformable portions in the toe-side recessed portion 32 and the heel-side recessed portion 33 need only be more than the number of the readily deformable portions of the middle recessed portion 31. Accordingly, it is also possible, for example, to make the number of the readily deformable portions of the middle recessed portion 31 zero, and make the number of the readily deformable portions of the toe-side recessed portion 32 and the heel-side recessed portion 33 one or more.

<7-2>

The readily deformable portions 311, 320 and 330 are not particularly limited in shape, and need only not extend parallel to the face-back direction. Accordingly, the readily deformable portions may extend straight in the toe-heel direction, or may extend at an angle to the toe-heel direction, such as in the above embodiment, with the size of this angle not being particularly limited.

<7-3>

Figure 12A:
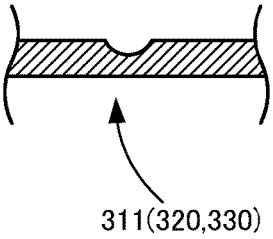
FIGS. 12A to 12C are cross-sectional views showing other examples of the cross-section of the recessed portions.
Figure 12B:
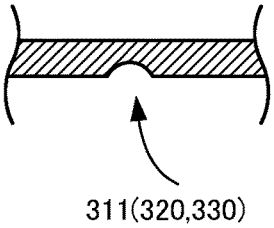
Figure 12C:
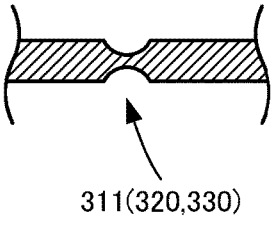

In the above embodiment, the readily deformable portions are formed by a step portion, but are not particularly limited as long as they are readily deformable by impact on the face portion 1. For example, as shown in FIGS. 12A to 12C, the readily deformable portions 311, 320 and 330 may be formed by a thin-walled structure.

<7-4>

As long as the number of readily deformable portions is set as described above, the shape of each of the recessed portions 31 to 33 is not particularly limited. Accordingly, all of the recessed portions 31 to 33 may, for example, extend in the face-back direction in a similar manner. The positions of the recessed portions 31 to 33 in the face-back direction are also not limited, and the positions on the face side of all of the recessed portions 31 to 33 may be aligned, for example. The shape of portions other than the recessed portions 31 to 33 of the sole portion 3 is also not particularly limited.

<7-5>

The head according to the above embodiment has a cup face structure, but other forms are possible. For example, the head can be constituted by fitting the crown portion 2 into an opening for the crown portion formed in a head main body that includes the face portion 1 and the sole portion 3. Also, a cup face structure need not be adopted, and the head can also be constituted by fitting a plate-like face member into an opening formed in the face portion 1 and welding the face member to the head main body.

<7-6>

The shape of the crown portion 2 is not particularly limited, and can be appropriately modified, with a raised portion 21 such as described above not needing to be formed.

LIST OF REFERENCE NUMERALS

1 Face portion
2 Crown portion
3 Sole portion
31 Central recessed portion
311 Readily deformable portion
32 Toe-side recessed portion
321-323 Readily deformable portion
33 Heel-side recessed portion
331-333 Readily deformable portion
4 Hosel portion

What is claimed is:

1. A golf club head comprising:
a face portion;
a crown portion; and
a sole portion,
wherein the sole portion includes:
a toe-side recessed portion arranged on a toe side;
a heel-side recessed portion arranged on a heel side; and
a middle recessed portion arranged between the toe-side recessed portion and the heel-side recessed portion, and
at least one readily deformable portion that extends linearly in a toe-heel direction is formed in the toe-side recessed portion and the heel-side recessed portion.

2. The golf club head according to claim 1,
wherein two or more of the readily deformable portion are formed in the toe-side recessed portion and the heel-side recessed portion,
at least one readily deformable portion extending linearly in the toe-heel direction is formed in the middle recessed portion, and
a number of the readily deformable portions formed in the toe-side recessed portion and the heel-side recessed portion is greater than a number of the readily deformable portions formed in the middle recessed portion.

3. The golf club head according to claim 1, wherein a length of the toe-side recessed portion and the heel-side recessed portion in a face-back direction is greater than a length of the middle recessed portion in the face-back direction.

4. The golf club head according to claim 1,
wherein the toe-side recessed portion is formed to increase in length in the face-back direction, moving toward the toe side, and
the heel-side recessed portion is formed to increase in length in the face-back direction, moving toward the heel side.

5. The golf club head according to claim 1, wherein the toe-side recessed portion and the heel-side recessed portion are arranged further on a face side than the middle recessed portion.

6. The golf club head according to claim 1,
wherein the readily deformable portion arranged in the toe-side recessed portion is formed to extend further on the back side, moving toward the toe side, and
the readily deformable portion arranged in the heel-side recessed portion is formed to extend further on the back side, moving toward the heel side.

7. The golf club head according to claim 1,
wherein a depth of the toe-side recessed portion becomes shallower moving toward the toe side, and
a depth of the heel-side recessed portion becomes shallower moving toward the heel side.

8. The golf club head according to claim 1, wherein a thickness of the toe-side recessed portion and the heel-side recessed portion is smaller than a thickness of the middle recessed portion.

9. The golf club head according to claim 1, wherein the readily deformable portion of the toe-side recessed portion, the heel-side recessed portion and the middle recessed portion is formed by a step.

10. The golf club head according to claim 9, the surface on the face side is connected to a lower end of the step, and the surface on the back side is connected to an upper end of the step across the step extending generally in the up-down direction.

11. The golf club head according to claim 9, wherein the upper end of the step is located further on the upper side than the surface of the sole portion.

12. The golf club head according to claim 1, wherein the readily deformable portion of the toe-side recessed portion, the heel-side recessed portion and the middle recessed portion is formed by a thin-wall portion.

13. The golf club head according to claim 1, wherein the region further on a back side than the middle recessed portion is located between the toe-side recessed portion and the heel-side recessed portion.

14. The golf club head according to claim 1, wherein the middle recessed portion is formed in a generally rectangular shape.

15. The golf club head according to claim 1, wherein the toe-side recessed portion is formed in a generally triangular shape toward the toe side, and the one of the corners of the toe-side recessed portion is connected to the middle recessed portion.

16. The golf club head according to claim 1, wherein the heel-side recessed portion is formed in a generally triangular shape toward the heel side, and the one of the corners of the heel-side recessed portion is connected to the middle recessed portion.

* * * * *